US007648953B2

(12) United States Patent
Bastigkeit et al.

(10) Patent No.: US 7,648,953 B2
(45) Date of Patent: Jan. 19, 2010

(54) ECO-FRIENDLY LAUNDRY DETERGENT COMPOSITIONS COMPRISING NATURAL ESSENCE

(75) Inventors: Thorsten Bastigkeit, Wupperdal (DE); Tyler Mikkelsen, Chandler, AZ (US); Daniel S. Wood, Phoenix, AZ (US); Daniel L. Carter, Anthem, AZ (US); Pamela Lam, Scottsdale, AZ (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 12/151,597

(22) Filed: May 8, 2008

(65) Prior Publication Data

US 2009/0281010 A1 Nov. 12, 2009

(51) Int. Cl.
*C11D 1/29* (2006.01)
*C11D 1/72* (2006.01)
*C11D 3/50* (2006.01)

(52) U.S. Cl. ..... 510/360; 510/101; 510/331; 510/351; 510/356; 510/357; 510/421; 510/426; 510/492; 510/531

(58) Field of Classification Search ..... 510/101, 510/331, 351, 356, 357, 360, 421, 426, 474, 510/492, 531
See application file for complete search history.

(56) References Cited

U.S. PATENT DOCUMENTS 5,003,057 A 3/1991 McCurry et al.
5,030,378 A 7/1991 Venegas
5,338,491 A * 8/1994 Connor et al. ..... 510/299
5,677,272 A 10/1997 Ghosh et al.
5,679,630 A 10/1997 Baeck et al.
5,703,027 A 12/1997 Caravajal et al.
5,703,034 A 12/1997 Offshack et al.
5,705,464 A 1/1998 Scheper et al.
5,707,950 A 1/1998 Kasturi et al.
5,707,951 A 1/1998 Masschelein et al.
5,710,115 A 1/1998 Patel et al.
5,710,116 A 1/1998 Miracle et al.
5,710,118 A 1/1998 Busch et al.
5,710,119 A 1/1998 Busch et al.
5,721,202 A 2/1998 Waite et al.
5,763,257 A 6/1998 Bott et al.
5,972,682 A 10/1999 Bott et al.
6,060,441 A 5/2000 Hessel et al.
6,136,778 A 10/2000 Kamiya
6,333,301 B1 12/2001 Kamiya
6,407,051 B1 6/2002 Smith et al.
6,465,235 B1 10/2002 Bott et al.
7,030,077 B2 4/2006 Beers et al.
7,033,984 B2 4/2006 Hafkamp et al.
2002/0137658 A1 * 9/2002 Faber ..... 510/470
2003/0082131 A1 * 5/2003 Drapier et al. ..... 424/70.24
2006/0205628 A1 9/2006 Deinhammer et al.

* cited by examiner

*Primary Examiner*—Brian P Mruk
(74) *Attorney, Agent, or Firm*—Paul A. Pappalardo

(57) ABSTRACT

A unique eco-friendly liquid laundry detergent enhanced with natural essence and further comprising non-petroleum source anionic and nonionic surfactants, naturally occurring builders, and optional enzymes, to yield remarkably effective yet environmentally responsible detergents.

8 Claims, No Drawings

ECO-FRIENDLY LAUNDRY DETERGENT COMPOSITIONS COMPRISING NATURAL ESSENCE

FIELD OF INVENTION

The present invention relates to detergent compositions comprising only biodegradable and eco-friendly ingredients that exhibit exceptional performance compared to traditional detergent formulations that use less friendly surfactant and builder ingredients. In particular, this invention relates to ecologically responsible liquid laundry detergent compositions that utilize unique surfactant-builder-enzyme combinations in conjunction with performance boosting natural essences.

BACKGROUND OF THE INVENTION

Liquid laundry detergents have been known in the art for decades. Modern detergents are often comprised of blends of synthetic anionic, nonionic and cationic surfactants, along with any number of additional ingredients such as builders, water-conditioners, dispersants, soil-release polymers, detersive enzymes and bleaching agents to improve cleaning performance and to achieve performance/cost optimized compositions that are consumer acceptable. Although major strides over decades have moved laundry detergents away from environmentally adverse ingredients such as phosphates, much of the liquid detergents today unfortunately continue to use synthetic surfactants that although biodegradable, pollute nonetheless because they are petroleum derived. Many of the surfactants used today are of petroleum base rather than vegetable or animal sourced, with some surfactants even having biodegradation products that are suspect hormone mimics. Additionally, some solvents, synthetic polymers, chelants, and bleaching agents may also have adverse environmental impact. The art is nearly void of compositions that claim the use of eco-friendly ingredients yet still have suitable performance. Heretofore there have simply been no suitable "across-the-board" substitutions of unfriendly ingredients with eco-friendly ingredients in a laundry detergent composition that can provide consumer acceptable performance at reasonable cost to the manufacturer. It is simple (as shown in the art) to make small substitutions, for example, reduction of builder and/or surfactant levels by increasing enzyme levels, or elimination of phosphates by substitution with other carbonate or bicarbonate builders and biodegradable chelants, but no where is there described the complete replacement of all ingredients in a composition with eco-friendly ingredients to produce an environmentally responsible composition that still provides comparable performance.

One way to increase performance in a laundry detergent and concomitantly reduce pollution is to replace high surfactant and builder levels with high enzyme levels. This strategy is well known in the art, for example US Patent Application Publication US2006/0205628 to Novozymes describes in general terms the "replacement of surfactants, builders, polymers, and bleaches in detergent compositions with enzymes". However, it is problematic to apply this strategy for the replacement of all pollution-impacting ingredients within a composition, as the required multiple types of enzymes need to be combined and stabilized in ways that heretofore have not been explored, and additional ingredients beyond the enzymes will be needed to make up for lost performance, (e.g. abnormally high levels of optical brightener, or synthetic polymers). For example, when common surfactants are replaced with eco-friendly surfactants, and the highly alkaline builder/chelant systems are eliminated, then simply increasing enzyme level is not enough, and the technology that is truly missing from the art is how to combine the right combinations of different enzymes at the right levels, using the right enzyme stabilizers with the right eco-friendly co-ingredients to boost the performance back to consumer acceptable levels.

Perhaps the best attempt to achieve a multiple-enzyme/surfactant based laundry detergent system is described in U.S. Pat. No. 6,060,441 to Hessel, et al. Unfortunately in this disclosure there are no specifically defined formulations placed into tables. Only design of experiments conducted with wide ranges of each ingredient. However, the '441 Hessel patent does show that a triple combination of surfactants, including fatty alkyl ether sulfate, linear alcohol ethoxylate, and nonionic sugar surfactant (alkyl polyglycoside), are required in combination to successfully stabilize a multi-enzyme formula and to get suitable performance. What is seen from examining the DOE results disclosed in this patent is that linear alcohol ethoxylate is essential to optimized protease, lipase and cellulose activity. Herein we will show this nonionic to not be necessary for enzyme stability.

Incorporating essential oils into detergent compositions is barely known in the laundry detergent context. However, solvent cleaners containing essential oils are well known in institutional and household hard surface cleaning. For example, the popular OrangeGlo® cleaners, marketed by Church & Dwight Co., Inc., are stable micro-emulsions of natural oils such as orange oil in water with surfactants and other ingredients. Patent examples include U.S. Pat. No. 6,407,051 to Smith, et al. that describes emulsifying oils or hydrocarbons such as mineral oil, mineral spirits, pine oil, fatty esters, carboxylic diester oils, motor oils, or triglycerides, and the like into stable water-in-oil micro-emulsions through a combination of alcohol ethoxylate and alkyl polyglycoside surfactant mixtures. The compositions described by Smith can in theory be used for hard surface, laundry cleaning, hand washing, and car washing. These formulas show performance on typical hydrophobic soils derived from petroleum oils or natural fats and oils, and particulate soils such as carbon, common dirt and other soils.

U.S. Pat. No. 6,136,778 to Kamiya describes the incorporation of essential oils into dishwashing detergents at levels where the essential oil contributes a great deal to the overall cleaning performance. The compositions within the Kamiya '778 patent may be used for both manual and mechanical warewashing. For example, Kamiya claims a detergent composition comprising (1) from 0.1% to 20% by weight of one or more essential oils (such as pinene, limonene, geraniol and the like), (2) from 0.25% to 20% by weight of a surfactant (such as N-cocoacyl-L-glutamate and/or coconut diethanolamide), and (3) an enzyme. These compositions would not be effective in laundry applications as the surfactant systems are inappropriate for fabric cleaning.

Additionally, U.S. Pat. No. 6,333,301 also to Kamiya claims a particulate detergent incorporating as much as 10% by weight of terpenes. These high levels of terpene are possible because they are absorbed onto bicarbonate, which has reasonable absorptivity for liquid ingredients. The Kamiya '301 patent does not teach a way to achieve these levels of natural extracts into liquids.

Finally, U.S. Pat. No. 7,033,984 to Hafkamp, et al., and U.S. Pat. No. 7,030,077 to Beers, et al., claim herbal benefit in the laundry through the incorporation of herbal extracts in laundry detergents that deposit the benefit agent onto the clothing that then transfers the benefit agent to the person wearing that clothing. The compositions claimed by Unilever are granular and the herbal agents are incorporated into prilled particles at levels far lower than would provide a performance benefit (for example, aloe at 0.005% by weight). Being these are neither liquid compositions nor using essential oils as performance aids, there is nothing from that art that teaches the present invention to be described below.

A perusal of the prior art demonstrates an absence of ecologically responsible liquid laundry detergents that can maintain consumer desired performance characteristics. In particular the art abounds with enzymatic detergents described over a few decades, most using the same combinations of unfriendly and environmentally suspect ingredients with these enzymes, yet no ultimate accomplishment in arriving at liquid laundry detergent compositions wherein all of the eco-suspect ingredients are gone yet the product still performs at a consumer acceptable level.

SUMMARY OF THE INVENTION

It has now been surprisingly found that the combination of certain biodegradable naturally derived surfactants with "natural essences" can lead to stable liquid laundry detergents that are comprised entirely of eco-friendly ingredients, yet still give performance at par or even superior to past traditional liquids that use much less friendly constituents. Most importantly, the natural essences aid enzyme stability such that fatty alcohol ethoxylate surfactant becomes optional.

Our summary of the invention is intended to introduce the reader to general aspects of the detergent compositions and not intended to be a complete description. Particular aspects of the present invention are described in other sections below.

In summary, the present invention describes eco-friendly liquid laundry detergent compositions comprising biodegradable, non-petroleum derived anionic and nonionic surfactants, with "natural essences" (essential oils or other natural extracts). In accordance with an exemplary embodiment of the present invention, liquid laundry detergent compositions are provided that show remarkable performance even though they utilize only eco-friendly ingredients. More specifically, an exemplary embodiment of the present invention is a liquid laundry detergent composition comprising fatty alcohol ether sulfate, alcohol ethoxylate, sodium bicarbonate and natural essence, and yet another embodiment comprises fatty alcohol ether sulfate, alkyl polyglycoside, enzymes and d-limonene or other essential oil or natural extract natural essence. Such compositions incorporate natural essences as enzyme stabilizers and performance enhancers, being replacements for less friendly surfactant/builder components, and utilize only naturally derived, eco-friendly surfactants.

DETAILED DESCRIPTION OF THE INVENTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and relative amounts of components described without departing from the scope of the invention as set forth in the appended claims.

The present invention relates to a composition for laundering fabrics that exhibit good performance such as stain removal and whiteness retention even though the compositions are comprised entirely of ecologically responsible ingredients. The liquid laundry detergent compositions of the present invention include anionic surfactant components, preferably alkyl ether sulfates, alkyl sulfate, alpha-sulfonated fatty acid esters, and/or fatty acid soaps, which together total from about 1% to about 20%; nonionic surfactants, most preferably the non-petroleum derived fatty alcohol ethoxylates and/or alkyl polyglycoside surfactants, totaling from about 1% to about 10%; a "natural essence" such as an essential oil, natural tree, plant, fruit, nut or seed extract, or other purified synthetic organic material to boost performance and enzyme stability, and in many instances to also provide fragrance, totally from about 0.1% to about 5%; a builder, most preferably carbonate, borate, bicarbonate, hydroxide, and/or citrate, present from about 0.1% to about 10%; optionally a soil dispersant/anti-redeposition or soil releasing polymer from about 0.1% to about 5%; and, optionally one or more detersive enzymes at from about 0.0001% to about 5%.

Anionic Surfactant Component

The eco-friendly detergent compositions of the present invention include at least one anionic surfactant. Preferred anionic surfactants for use in the present invention include the alkyl ether sulfates, also known as alcohol ether sulfates. Alcohol ether sulfates are the sulfuric monoesters of the straight chain or branched alcohol ethoxylates and have the general formula $R—(OCH_2CH_2)_x—O—SO_3M$, where R preferably comprises $C_7$-$C_{21}$ alcohol ethoxylated with from about 0.5 to about 9 mol of ethylene oxide (i.e., x=0.5 to 9 EO), such as $C_{12}$-$C_{18}$ alcohols containing from 0.5 to 9 EO, and where M is alkali metal or ammonium, alkyl ammonium or alkanol ammonium counterion. Preferred alkyl ether sulfates for use in one embodiment of the present invention are $C_8$-$C_{18}$ alcohol ether sulfates with a degree of ethoxylation of from about 0.5 to about 9 ethylene oxide moieties and most preferred are the $C_{12}$-$C_{15}$ alcohol ether sulfates with ethoxylation from about 4 to about 9 ethylene oxide moieties, with 7 ethylene oxide moieties being most preferred. In keeping with the spirit of only using natural feedstock for ingredients for an eco-friendly detergent of the present invention, the fatty alcohol portion of the surfactant is preferably animal or vegetable derived, rather than petroleum derived. Therefore the fatty alcohol portion of the surfactant will comprise distributions of even number carbon chains, e.g. $C_{12}$, $C_{14}$, $C_{16}$, $C_{18}$, and so forth. It is understood that when referring to alkyl ether sulfates, these substances are already salts (hence "sulfate" nomenclature), and most preferred and most readily available are the sodium alkyl ether sulfates (also referred to as NaAES, or simply FAES). Commercially available alkyl ether sulfates include the CALFOAM® alcohol ether sulfates from Pilot Chemical, the EMAL®, LEVENOL® and LATEMAL® products from Kao Corporation, and the POLYSTEP® products from Stepan, most of these with fairly low EO content (e.g., average 3 or 4-EO). Alternatively the alkyl ether sulfates for use in the present invention may be prepared by sulfonation of alcohol ethoxylates (i.e., nonionic surfactants) if the commercial alkyl ether sulfate with the desired chain lengths and EO content are not easily found, but perhaps where the nonionic alcohol ethoxylate starting material may be. For example, sodium lauryl ether sulfate ("sodium laureth sulfate", having about 2-3 ethylene oxide moieties) is very readily available commercially and quite common in shampoos and detergents. Sodium lauryl ether sulfate is preferred for use in the detergents of the present invention. Depending on the degree of ethoxylation desired, it may be more practical to sulfonate a commercially available nonionic surfactant such as Neodol® 25-7 Primary Alcohol Ethoxylate (a $C_{12}$-$C_{15}$/7EO nonionic from Shell) to obtain for example the $C_{12}$-$C_{15}$/7EO alkyl ether sulfate that may have been more difficult to source commercially. However, the most preferred alkyl ether sulfate for use in the present invention is sodium lauryl sulfate-2EO, available as Calfoam® ES-302 from Pilot Chemical. The preferred level of $C_{12}$-$C_{18}$/0.5-9EO alkyl ether sulfate for use in the present invention is from about 1% to about 50%. More preferred is to incorporate sodium lauryl ether sulfate (e.g. Calfoam® ES-302) from about 3% to about 15% actives weight basis.

Other anionic surfactants that may find use in the compositions of the present invention include the alpha-sulfonated alkyl esters of $C_{12}$-$C_{16}$ fatty acids. The alpha-sulfonated alkyl esters may be pure alkyl ester or a blend of (1) a mono-salt of an alpha-sulfonated alkyl ester of a fatty acid having from 8-20 carbon atoms where the alkyl portion forming the ester is straight or branched chain alkyl of 1-6 carbon atoms and (2) a di-salt of an alpha-sulfonated fatty acid, the ratio of mono-salt to di-salt being at least about 2:1. The alpha-sulfonated alkyl esters useful herein are typically prepared by sulfonating an alkyl ester of a fatty acid with a sulfonating agent such as $SO_3$. When prepared in this manner, the alpha-sulfonated alkyl esters normally contain a minor amount, (typically less than 33% by weight), of the di-salt of the alpha-sulfonated fatty acid which results from saponification of the ester. Preferred alpha-sulfonated alkyl esters contain less than about 10% by weight of the di-salt of the corresponding alpha-sulfonated fatty acid.

The alpha-sulfonated alkyl esters, i.e., alkyl ester sulfonate surfactants, include linear esters of $C_8$-$C_{20}$ carboxylic acids that are sulfonated with gaseous $SO_3$ as described in the "The Journal of American Oil Chemists Society," 52 (1975), pp. 323-329. Suitable starting materials preferably include natural fatty substances as derived from tallow, palm oil, etc., rather than petroleum derived materials. The preferred alkyl ester sulfonate surfactants, especially for laundry detergent compositions of the present invention, comprise alkyl ester sulfonate surfactants of the structural formula $R^3$—CH($SO_3M$)-$CO_2R^4$, wherein $R^3$ is a $C_8$-$C_{20}$ hydrocarbon chain preferably naturally derived, $R^4$ is a straight or branched chain $C_1$-$C_6$ alkyl group and M is a cation which forms a water soluble salt with the alkyl ester sulfonate, including sodium, potassium, magnesium, and ammonium cations. Preferably, $R^3$ is $C_{10}$-$C_{16}$ fatty alkyl, and $R^4$ is methyl or ethyl. Most preferred are alpha-sulfonated methyl or ethyl esters of a distribution of fatty acids having an average of from 12 to 16 carbon atoms. For example, the alpha-sulfonated esters; Alpha-Step® BBS-45, Alpha-Step® MC-48, and Alpha-Step® PC-48, all available from the Stepan Co. of Northfield, Ill., may find use in the present invention. However, the methyl esters are derived from methanol sources. Thus, the ethyl esters, which are currently not commercially available, would be the most preferred alpha-sulfonated fatty acid esters. When used in the present invention, the alpha-sulfonated alkyl ester is preferably incorporated at from about 3% to about 15% by weight actives.

The compositions of the present invention may also include fatty acid soaps as an anionic surfactant ingredient. The fatty acids that may find use in the present invention may be represented by the general formula R—COOH, wherein R represents a linear or branched alkyl or alkenyl group having between about 8 and 24 carbons. It is understood that within the compositions of the present invention, the free fatty acid form (the carboxylic acid) will be converted to the carboxylate salt in-situ (that is, to the fatty acid soap), by the excess alkalinity present in the composition from added alkaline builder. As used herein, "soap" means salts of fatty acids. Thus, after mixing and obtaining the compositions of the present invention, the fatty acids will be present in the composition as R—COOM, wherein R represents a linear or branched alkyl or alkenyl group having between about 8 and 24 carbons and M represents an alkali metal such as sodium or potassium. The fatty acid soap, which is often a desirable component having suds reducing effect in the washer, (and especially advantageous for side loading or horizontal tub laundry machines), is preferably comprised of higher fatty acid soaps. The fatty acids that are added directly into the compositions of the present invention may be derived from natural fats and oils, such as those from animal fats and greases and/or from vegetable and seed oils, for example, tallow, hydrogenated tallow, whale oil, fish oil, grease, lard, coconut oil, palm oil, palm kernel oil, olive oil, peanut oil, corn oil, sesame oil, rice bran oil, cottonseed oil, babassu oil, soybean oil, castor oil, and mixtures thereof. Although fatty acids can be synthetically prepared, for example, by the oxidation of petroleum, or by hydrogenation of carbon monoxide by the Fischer-Tropsch process, the naturally obtainable fats and oils are preferred. The fatty acids of particular use in the present invention are linear or branched and containing from about 8 to about 24 carbon atoms, preferably from about 10 to about 20 carbon atoms and most preferably from about 14 to about 18 carbon atoms. Preferred fatty acids for use in the present invention include coconut, tallow or hydrogenated tallow fatty acids, and most preferred is to use entirely coconut fatty acid. Preferred salts of the fatty acids are alkali metal salts, such as sodium and potassium or mixtures thereof and, as mentioned above, preferably the soaps generated in-situ by neutralization of the fatty acids with excess alkali from the silicate. Other useful soaps are ammonium and alkanol ammonium salts of fatty acids, with the understanding that these soaps would necessarily be added to the compositions as the preformed ammonium or alkanol ammonium salts and not neutralized in-situ within the added alkaline builders of the present invention. The fatty acids that may be included in the present compositions will preferably be chosen to have desirable detergency and suds reducing effect. Fatty acid soaps may be incorporated in the compositions of the present invention at from about 1% to about 10%.

The compositions of the present invention may also include alkyl sulfate as the sole anionic surfactant component, or in combination with one of more other anionic surfactants mentioned above. Fatty alkyl sulfates have the general formula R—$SO_3M$, where R preferably comprises a $C_7$-$C_{21}$ fatty alkyl chain, and where M is alkali metal or ammonium, alkyl ammonium or alkanol ammonium counterion. Preferred alkyl sulfates for use in the present invention are $C_8$-$C_{18}$ fatty alkyl sulfate. Most preferred is to incorporate sodium lauryl sulfate, such as Standapol® WAQ-LC marketed by Cognis, and to have from about 1% to about 10% by actives weight basis in the composition.

The Nonionic Surfactant Component

The compositions of the present invention also include at least one nonionic surfactant since these materials are particularly good at removing oily soils from fabrics and may be naturally derived and have good biodegradability. For example, the liquid compositions herein may contain ethoxylated primary alcohols represented by the general formula R—$(OCH_2CH_2)_x$—OH, where R is $C_{10}$ to $C_{18}$ carbon atoms preferably from natural, non-petroleum sources, and x is on average from 4 to 12 mol of ethylene oxide (EO). Further examples are alcohol ethoxylates containing linear radicals from alcohols of natural origin having 12 to 18 carbon atoms, e.g., from coconut, palm, tallow fatty or oleyl alcohol and on average from 4 to about 12 EO per mole of alcohol. Most useful as a nonionic surfactant in the present invention is the $C_{12}$-$C_{14}$ alcohol ethoxylate-7EO, and the $C_{12}$-$C_{14}$ alcohol ethoxylate-12EO incorporated in the composition at from about 1% to about 10%. Preferred nonionic surfactants for use in this invention include for example, Neodol® 45-7, Neodol® 25-9, or Neodol® 25-12 from Shell Chemical Company and most preferred are Surfonic® L24-7, which is a $C_{12}$-$C_{14}$ alcohol ethoxylate-7EO, and Surfonic® L24-12, which is a $C_{12}$-$C_{14}$ alcohol ethoxylate-12EO, both available from Huntsman. Combinations of more than one alcohol ethoxylate surfactant may also be desired in the detergent composition in order to maximize cleaning performance in the washing machine.

Nonionic surfactants useful in the present invention may also include the alkyl polyglycoside surfactants. The alkyl polyglycosides (APGs), also called alkyl polyglucosides if the saccharide moiety is glucose, are naturally derived, nonionic surfactants. The alkyl polyglycosides that may be used in the present invention are fatty ester derivatives of saccharides or polysaccharides that are formed when a carbohydrate is reacted under acidic condition with a fatty alcohol through condensation polymerization. The APGs are typically derived from corn-based carbohydrates and fatty alcohols from natural oils in animals, coconuts and palm kernels. Such methods for preparing APGs are well known in the art. For example, U.S. Pat. No. 5,003,057 to McCurry, et al., incorporated herein, describes methods for making APGs, along with their chemical properties. The alkyl polyglycosides that are preferred for use in the present invention contain a hydrophilic group derived from carbohydrates and is composed of one or more anhydroglucose units. Each of the glucose units can have two ether oxygen atoms and three hydroxyl groups, along with a terminal hydroxyl group, which together impart water solubility to the glycoside. The presence of the alkyl carbon chain leads to the hydrophobic tail to the molecule. When carbohydrate molecules react with fatty alcohol compounds, alkyl polyglycoside molecules are formed having single or multiple anhydroglucose units, which are termed monoglycosides and polyglycosides, respectively. The final alkyl polyglycoside product typically has a distribution of varying concentration of glucose units (or degree of polymerization).

The APGs that may be used in the detergent composition of the invention preferably comprise saccharide or polysaccharide groups (i.e., mono-, di-, tri-, etc. saccharides) of hexose or pentose, and a fatty aliphatic group having 6 to 20 carbon atoms. Preferred alkyl polyglycosides that can be used according to the present invention are represented by the general formula, $G_x$-O—$R^1$, wherein G is a moiety derived from reducing saccharide containing 5 or 6 carbon atoms, e.g., pentose or hexose; $R^1$ is fatty alkyl group containing 6 to 20 carbon atoms; and x is the degree of polymerization of the polyglycoside, representing the number of monosaccharide repeating units in the polyglycoside. Generally, x is an integer on the basis of individual molecules, but because there are statistical variations in the manufacturing process for APGs, x may be a noninteger on an average basis when referred to APG used as an ingredient for the detergent composition of the present invention. For the APGs of use in the compositions of the present invention, x preferably has a value of less than 2.5, and more preferably is between 1 and 2. Exemplary saccharides from which G can be derived are glucose, fructose, mannose, galactose, talose, gulose, allose, altrose, idose, arabinose, xylose, lyxose and ribose. Because of the ready availability of glucose, glucose is preferred in polyglycosides. The fatty alkyl group is preferably saturated, although unsaturated fatty chains may be used. Generally, the commercially available polyglycosides have $C_8$ to $C_{16}$ alkyl chains and an average degree of polymerization of from 1.4 to 1.6.

Commercially available alkyl polyglycoside can be obtained as concentrated aqueous solutions ranging from 50 to 70% actives and are available from Cognis. Most preferred for use in the present compositions are APGs with an average degree of polymerization of from 1.4 to 1.7 and the chain lengths of the aliphatic groups are between $C_8$ and $C_{16}$. For example, one preferred APG for use herein has chain length of $C_8$ and $C_{10}$ (ratio of 45:55) and a degree of polymerization of 1.7. The detergent compositions of the present invention have the advantage of having less adverse impact on the environment than conventional detergent compositions. Alkyl polyglycosides used in the present invention exhibit low oral and dermal toxicity and irritation on mammalian tissues. These alkyl polyglycosides are also biodegradable in both anaerobic and aerobic conditions and they exhibit low toxicity to plants, thus improving the environmental compatibility of the rinse aid of the present invention. Because of the carbohydrate property and the excellent water solubility characteristics, alkyl polyglycosides are compatible in high caustic and builder formulations. The detergent compositions may include a sufficient amount of alkyl polyglycoside surfactant in an amount that provides a desired level of cleaning on fabrics, that being from about 0.01% and about 10% by weight alkyl polyglycoside surfactant. Most preferred is to include an amount between about 0.5% and about 5% by weight actives.

The Natural Essences Component

In addition to anionic and nonionic surfactant components, the liquid laundry detergents compositions of the present invention include a "natural essence". As referred to for purposes of this invention, "natural essence" is intended to include a broader class of natural products comprising natural oils extracted from plants and trees and their fruits, nuts and seeds, (for example by steam or liquid extraction of ground-up plant/tree material), natural products that may be purified by distillation, (i.e., purified single organic molecules or close boiling point "cuts" of organic materials such as terpenes and the like), and synthetic organic materials that are the synthetic versions of naturally occurring materials (e.g., either identical to the natural material, or the optical isomer, or the racemic mixture). An example of the latter is D,L-limonene that is synthetically prepared and is a good and eco-friendly substitute for natural orange oil (mostly D-limonene) when crop yields are expensive due to citrus crop freezes. Thus, it should be understood that "natural essence" incorporates a wide range of pure organic materials either natural or synthetic versions thereof, mixtures of these previously purified individual materials or distillate cuts of materials, and complex natural mixtures directly extracted from plant/tree materials through infusion, steam extraction, etc. Also, it should be understood that these natural essence ingredients may double as fragrance materials for the detergent composition, and in fact many natural extracts, oils, essences, infusions and such are very fragrant materials. However, for use in the present compositions, these materials are used at higher levels than would be typical for fragrance purposes, and it should be also understood that depending on optical isomers used, there may be no smell or a reduced smell, or even a masking effect to the human sensory perception. Thus by judicious choice of natural essence mixtures, performance boosting may be effected without making the compositions overwhelmingly scented. Also, actual fragrance masking materials (such as used for household cleaners and available from the fragrance supply houses such as International Flavors & Fragrances, Symrise, Givaudan, Firmenich, and others) may be added to mask the smells of the natural essences.

Some of the naturally derived essences for use in the present compositions include, but are not limited to, musk, civet, ambergis, castoreum and similar animal derived oils; abies oil, ajowan oil, almond oil, ambrette seed absolute, angelic root oil, anise oil, basil oil, bay oil, benzoin resinoid, bergamot oil, birch oil, bois de rose oil, broom abs., cajeput oil, cananga oil, capsicum oil, caraway oil, cardamon oil, carrot seed oil, cassia oil, cedar leaf oil, cedar wood oil, celery seed oil, cinnamon bark oil, citronella oil, clary sage oil, clove oil, cognac oil, coriander oil, cubeb oil, cumin oil, camphor oil, dill oil, elemi gum, estragon oil, eucalyptol nat., eucalyptus oil, fennel sweet oil, galbanum res., garlic oil, geranium oil, ginger oil, grapefruit oil, hop oil, hyacinth abs., jasmin abs., juniper berry oil, labdanum res., lavender oil, laurel leaf oil, lavender oil, lemon oil, lemongrass oil, lime oil, lovage oil, mace oil, mandarin oil, mimosa abs., myrrh abs., mustard oil, narcissus abs., neroli bigarade oil, nutmeg oil, oakmoss abs., olibanum res., onion oil, opoponax res., orange oil, orange flower oil, origanum, orris concrete, pepper oil, peppermint oil, peru balsam, petitgrain oil, pine needle oil, rose abs., rose oil, rosemary oil, safe officinalis oil, sandalwood oil, sage oil, spearmint oil, styrax oil, thyme oil, tolu balsam, tonka beans abs., tuberose abs., turpentine oil, vanilla beans abs., vetiver oil, violet leaf abs., ylang ylang oil and similar vegetable oils, etc.

Synthetic essences include but are not limited to pinene, limonene and like hydrocarbons; 3,3,5-trimethylcyclohexanol, linalool, geraniol, nerol, citronellol, menthol, borneol, borneyl methoxy cyclohexanol, benzyl alcohol, anise alcohol, cinnamyl alcohol, β-phenyl ethyl alcohol, cis-3-hexenol, terpineol and like alcohols; anethole, musk xylol, isoeugenol, methyl eugenol and like phenols; α-amylcinnamic aldehyde, anisaldehyde, n-butyl aldehyde, cumin aldehyde, cyclamen aldehyde, decanal, isobutyl aldehyde, hexyl aldehyde, heptyl aldehyde, n-nonyl aldehyde, nonadienol, citral, citronellal, hydroxycitronellal, benzaldehyde, methyl nonyl acetaldehyde, cinnamic aldehyde, dodecanol, α-hyxylcinnamic aldehyde, undecenal, heliotropin, vanillin, ethyl vanillin and like aldehydes; methyl amyl ketone, methyl β-naphthyl ketone, methyl nonyl ketone, musk ketone, diacetyl, acetyl propionyl, acetyl butyryl, carvone, menthone, camphor, acetophenone, p-methyl acetophenone, ionone, methyl ionone and like ketones; amyl butyrolactone, diphenyl oxide, methyl phenyl glycidate, gamma.-nonyl lactone, coumarin, cineole, ethyl methyl phenyl glicydate and like lactones or oxides; methyl formate, isopropyl formate, linalyl formate, ethyl acetate, octyl acetate, methyl acetate, benzyl acetate, cinnamyl acetate, butyl propionate, isoamyl acetate, isopropyl isobutyrate, geranyl isovalerate, allyl capronate, butyl heptylate, octyl caprylate octyl, methyl heptynecarboxylate, methine octynecarboxylate, isoacyl caprylate, methyl laurate, ethyl myristate, methyl myristate, ethyl benzoate, benzyl benzoate, methylcarbinylphenyl acetate, isobutyl phenylacetate, methyl cinnamate, cinnamyl cinnamate, methyl salicylate, ethyl anisate, methyl anthranilate, ethyl pyruvate, ethyl α-butyl butylate, benzyl propionate, butyl acetate, butyl butyrate, p-tert-butylcyclohexyl acetate, cedryl acetate, citronellyl acetate, citronellyl formate, p-cresyl acetate, ethyl butyrate, ethyl caproate, ethyl cinnamate, ethyl phenylacetate, ethylene brassylate, geranyl acetate, geranyl formate, isoamyl salicylate, isoamyl isovalerate, isobornyl acetate, linalyl acetate, methyl anthranilate, methyl dihydrojasmonate, nopyl acetate, β-phenylethyl acetate, trichloromethylphenyl carbinyl acetate, terpinyl acetate, vetiveryl acetate and the like.

Suitable essence mixtures may produce synergistic performance attributes for the detergent composition and may help to impart an overall fragrance perception as well to the composition including but not limited to, fruity, musk, floral, herbaceous (including mint), and woody, or perceptions that are in-between (fruity-floral for example). Typically these essence or essential oil mixtures may be compounded by mixing a variety of these active extract or synthetic materials along with various solvents to adjust cost, viscosity, flammability, ease of handling, etc. Since many natural extract ingredients are compounded into fragrances, the essential oils, infusions, distillates, etc. that are considered "natural essences" within this invention are also available from the fragrance companies such as International Flavors & Fragrances, Givaudan, Symrise, Firmenich, Robertet, and many others. The natural essences for use in the present invention are preferably incorporated at a level of from about 0.1% to about 5% as the 100% neat substance or mixture of substances. It is important to note that these levels tend to be greater than those used for scenting a product with a perfume.

The Builder Component

The liquid laundry detergent compositions of the present invention may also include at least one builder. Builders are well known in the laundry detergent art and include such species as hydroxides, carbonates, sesquicarbonates, bicarbonates, borates, citrates, silicates, zeolites, and such. Preferred builders for use in the present invention include but are not limited to sodium hydroxide (NaOH), potassium hydroxide (KOH), magnesium hydroxide ($Mg(OH)_2$), sodium carbonate ($Na_2CO_3$), potassium carbonate ($K_2CO_3$), sodium bicarbonate ($NaHCO_3$), potassium bicarbonate ($KHCO_3$), sodium sesquicarbonate ($Na_2CO_3.NaHCO_3.2H_2O$), sodium silicate ($SiO_2/Na_2O$), sodium borate ($Na_2B_4O_7$—$(H_2O)_{10}$ or "borax"), citric acid ($C_6H_8O_7$), monosodium citrate ($NaC_6H_7O_7$), disodium citrate ($Na_2C_6H_6O_7$), and trisodium citrate ($Na_3C_6H_5O_7$), and mixtures thereof. It should be understood that combinations of free acid materials (like citric acid) when combined with alkali such as sodium hydroxide can generate the mono-, di-, or trisodium salts of citric acid in situ. The preferred level of builder for use in these laundry detergents is from about 0.1% to about 5% by weight.

Polymer Components

The compositions of the present invention may also include at least one soil dispersing and/or anti-redeposition or water conditioning polymers such as sodium polyacrylate or carboxymethylcellulose (CMC). Particularly suitable polymeric polycarboxylates are derived from acrylic acid, and this polymer and the corresponding neutralized forms include and are commonly referred to as polyacrylic acid, 2-propenoic acid homopolymer or acrylic acid polymer, and sodium polyacrylate, 2-propenoic acid homopolymer sodium salt, acrylic acid polymer sodium salt, poly sodium acrylate, or polyacrylic acid sodium salt. Preferred in the compositions of the present invention is sodium polyacrylate with average molecular weight from about 2,000 to 10,000, more preferably from about 4,000 to 7,000 and most preferably from about 4,000 to 5,000. Soluble polymers of this type are known materials, for example the sodium polyacrylates and polyacrylic acids from Rohm and Haas marketed under the trade name Acusol®. Of particular use in the present invention is the average 4500 molecular weight sodium polyacrylate, (for example, Acusol® 425, Acusol® 430, Acusol® 445 and Acusol® 445ND, and mixtures of these), and carboxymethylcellulose, either or a combination of the two at a preferred level of from about 0.1% to about 3%. Polyacrylates are "biodegradable", however, the cellulosic materials such as CMC may show a faster biodegradation profile and may be more preferred in keeping with the spirit of the eco-friendly character of the present invention.

Electrolytes

The detergent compositions of the present invention may also include one or more electrolytes to adjust viscosity. For example, preferred electrolytes include but are not limited to sodium chloride, sodium sulfate, calcium chloride, and borax (sodium tetraborate-decahydrate), and combinations thereof. Of course, some of these have dual purposes such as alkalinity builders or enzyme stabilizers. When incorporated at a level of from about 0.1% to about 5%, large changes in viscosity may be made, and ordinarily "water-thin" liquids can be made to appear much more premium.

Enzyme Component

The compositions of the present invention may optionally include one or more detersive enzymes, either singly or in any combination of two or more. Enzymes may be included in the present detergent compositions for a variety of purposes, including removal of protein-based, carbohydrate-based, or triglyceride-based stains from substrates. Generally, suitable enzymes include cellulases, hemicellulases, proteases, glucoamylases, amylases, lipases, cutinases, pectinases, xylanases, keratinases, reductases, oxidases, phenoloxidases, lipoxygenases, ligninases, pullulanases, tannases, chondriotinases, thermitases, pentosanases, malanases, β-glucanases, arabinosidases or mixtures thereof of any suitable origin, such as vegetable, animal, bacterial, fungal and yeast origin. Preferred enzymes for use in the present invention are dictated by factors such as formula pH, thermostability, and stability to surfactants, builders and the like. In this respect bacterial or fungal enzymes are preferred, such as bacterial amylases and proteases, and fungal cellulases. A preferred combination is a detergent composition having a mixture of conventional detergent enzymes like protease, amylase, lipase, cutinase and/or cellulase. Suitable enzymes are also described in U.S. Pat. Nos. 5,677,272, 5,679,630, 5,703,027, 5,703,034, 5,705,464, 5,707,950, 5,707,951, 5,710,115, 5,710,116, 5,710,118, 5,710,119 and 5,721,202.

"Detersive enzyme", as used herein, means any enzyme having a cleaning, stain removing or otherwise beneficial effect in a detergent compositions. Preferred detersive enzymes are hydrolases such as proteases, amylases and lipases. Highly preferred are amylases and/or proteases, including both current commercially available types and improved types. Enzymes are normally incorporated into detergent compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. In other words, the compositions herein will typically comprise from 0.001% to 5%, preferably 0.001%-1% by weight of a commercial enzyme preparation. Protease enzymes are usually present in such commercial preparations at levels sufficient to provide from 0.005 to 0.1 Anson units (AU) of activity per gram of composition. For certain detergents it may be desirable to increase the active enzyme content of the commercial preparation in order to minimize the total amount of non-catalytically active materials and thereby improve spotting/filming or other end-results. Higher active levels may also be desirable in highly concentrated detergent formulations. Proteolytic enzymes can be of animal, vegetable or microorganism (preferred) origin. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*. Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.), which are described in U.S. Pat. Nos. 5,972,682, 5,763,257 and 6,465,235 and which are also called herein "Protease B". U.S. Pat. No. 5,030,378, Venegas, issued Jul. 9, 1991, refers to a modified bacterial serine proteolytic enzyme (Genencor International), which is called "Protease A" herein (same as BPN'). In particular, see columns 2 and 3 of U.S. Pat. No. 5,030,378 for a complete description, (including the amino sequence), of Protease A and its variants. Other proteases are sold under the tradenames: Primase®, Durazym®, Opticlean® and Optimase®. Preferred proteolytic enzymes, then, are selected from the group consisting of Alcalase® (Novo Industri A/S), BPN', Protease A and Protease B (Genencor), and mixtures thereof. Protease B is most preferred. The compositions of the present invention will preferably contain at least about 0.0001%, more preferably at least about 0.0005%, and most preferably at least about 0.001% by weight of the composition of enzyme. The detergent composition will also preferably contain no more than about 5%, more preferably no more than about 2%, and most preferably, no more than about 1% by weight of the composition of enzyme. Although proteases may be used alone, it is preferable to have a combination of protease and amylase, or a combination of protease, lipase and amylase in the compositions of the present invention.

Adjuvant

Optional ingredients for use in the present detergent compositions may also include peroxide and active oxygen ("peroxygen") organic and inorganic compounds for non-chlorine bleaching of bleachable stains. Such bleaching materials may include, but are not limited to hydrogen peroxide, sodium percarbonate and sodium perborate, or mixtures thereof.

Additional optional materials for use in the present detergents may include chelants such as tetrasodium ethylenediamine tetraacetate-EDTA, Trilon® chelants from BASF, phosphates, zeolite, nitrilotriacetate (NTA) and it's corresponding salts, optical brighteners, dye fixatives or transfer inhibitors, perfumes, additional fragrance and fragrance masking agents to coordinate with the natural essences, odor neutralizers, dyes, pigments and colorants, solvents, cationic surfactants, other softening or antistatic agents, thickeners, emulsifiers, bleach catalysts, enzyme stabilizers, clays, surface modifying polymers, pH-buffering agents, abrasives, preservatives and sanitizers or disinfectants, anti-redeposition agents, opacifiers, anti-foaming agents, cyclodextrin, rheology-control agents, vitamins and other skin benefit agents, nano-particles and encapsulated particles, visible plastic particles, visible beads, etc., and the like, and any combination of adjuvant.

Example Compositions and Performance Data

With the necessary and optional ingredients thus described, exemplary embodiments of the eco-friendly liquid laundry detergent compositions of the present invention, with each of the components set forth in weight percent actives (i.e., theoretical amounts after blending), are shown in TABLE 1. Referring to TABLE 1, Compositions 1-3 represent non-enzymatic compositions further containing alcohol ethoxylate nonionic surfactant, whereas Compositions 4-7 are the enzymatic compositions devoid of alcohol ethoxylate. Formula 1 makes use of a natural fruity extract that is rich in orange oil, lemon oil, cedar leaf oil, eucalyptol nat., safe officinalis oil, and elemi gum. Formula 2 incorporates a natural essence blend that is rich in grapefruit and orange oils, whilst Formula 3 incorporates a natural essence that is rich in lemon and orange oils, eugenol and petitgrain oils, and which also imparts a clean linen fragrance to the detergent composition. On the other hand, Compositions 4-7 include D-limonene as the natural essence. Formula 6 was self-thickening, while each of the remaining compositions shown in the table use sodium chloride to modify viscosity.

To demonstrate the cleaning performance characteristics of various formulations of the liquid detergent compositions of the present invention, tests were conducted to determine the stain removal capability. For evaluation purposes, under U.S. wash conditions, Kenmore Elite washers were used. The following conditions were used: Medium load, warm wash (100° F.), cold rinse, heavy duty agitation, 14 minute wash cycle, 1 rinse cycle, and addition of 150 ppm hard water to 150 ppm. The assessment of the removal of individual stain is determined by the color change of the stains as determined using a calorimeter. Similarly sized 100% cotton knit pieces of fabric that were each stained with one of chocolate ice cream, chocolate milk, grape juice, tea and wine were washed in a washing liquor containing water and one of the formulations shown in Table 1. The stain removal capabilities of these formulations were compared after washing the test pieces against white 100% cotton knit pieces of fabric and listed in

TABLE 1

Eco-Friendly Liquid Detergent Composition Examples

| Ingredient | Weight Percent (theoretical actives %) | | |
|---|---|---|---|
| | Formulation 1 | Formulation 2 | Formulation 3 |
| Sodium lauryl ether sulfate (2EO) (e.g. Calfoam ES-302) | 10.00 | 10.00 | 10.00 |
| Sodium lauryl sulfate (e.g. Standapol WAC-LC) | — | — | — |
| Coconut Fatty Acid | — | — | — |
| $C_{12}$-$C_{14}$/7EO fatty alcohol ethoxylate | 4.00 | 4.00 | 4.00 |
| Alkyl Polyglucoside | — | — | — |
| Natural Essence* | 0.32[1] | 0.25[2] | 0.33[3] |
| Sodium Bicarbonate | 0.50 | 0.50 | 0.50 |
| Sodium Tetraborate | — | — | — |
| Citric Acid | — | — | — |
| Sodium Hydroxide | — | — | — |
| Carboxy Methyl Cellulose (CMC) | — | — | — |
| Sodium Polyacrylate 4500 MW | 0.50 | 0.50 | 0.50 |
| Sodium Chloride | 2.40 | 2.45 | 2.40 |
| Calcium Chloride | — | — | — |
| Protease | — | — | — |
| Lipase | — | — | — |
| Amylase | — | — | — |
| Water, dyes, optical brightener, preservatives, fragrances. | 82.28 | 82.30 | 82.27 |

| Ingredient | Weight Percent (theoretical actives %) | | | |
|---|---|---|---|---|
| | Formulation 4 | Formulation 5 | Formulation 6 | Formulation 7 |
| Sodium lauryl ether sulfate (2EO) (Calfoam ES-302) | — | — | 7.750 | 7.750 |
| Sodium lauryl sulfate (Standapol WAC-LC) | 4.700 | — | — | — |
| Coconut Fatty Acid | — | 3.000 | — | — |
| $C_{12}$-$C_{14}$/7EO fatty alcohol ethoxylate | — | — | — | — |
| Alkyl Polyglucoside | 3.000 | 4.500 | 2.000 | 1.750 |
| Natural Essence* | 0.250[4] | 0.250[4] | 0.250[4] | 0.250[4] |
| Sodium Bicarbonate | — | — | — | — |
| Sodium Tetraborate | 1.000 | 1.000 | 1.000 | 0.500 |
| Citric Acid | 2.000 | 2.000 | 2.000 | 1.000 |
| Sodium Hydroxide | 1.000 | 1.600 | 1.000 | 0.490 |
| Carboxy Methyl Cellulose | — | 0.500 | — | — |
| Sodium Polyacrylate 4500 MW | 0.500 | — | — | 0.400 |
| Sodium Chloride | — | 1.000 | 2.000 | 2.100 |
| Calcium Chloride | 0.050 | 0.050 | 0.050 | 0.050 |
| Protease | 0.400 | 0.300 | 0.400 | 0.400 |
| Lipase | — | 0.075 | 0.150 | — |
| Amylase | 0.150 | 0.075 | 0.100 | — |
| Water, dyes, optical brightener, preservatives, fragrances. | 86.950 | 85.650 | 83.300 | 85.310 |

*The Natural Essences referenced in Table 1 are as follows: [1]= Watery/Fruit Natural Essence 241683 (Symrise), [2]= Vanilla/Orchid Natural Essence UP181516/00 (Givaudan), [3]= Linen Natural Essence 241684 (Symrise), [4]= D-Limonine.

Table 2 as the percent (%) of the stain remaining. Stain removal was assessed using color readings from a Gardner Color-Guide Spectrophotometer Model 45/0. As shown in Table 2, Formulas 1, 7 and 8, show acceptable performance notwithstanding the low actives levels and the eco-friendly. Natural essences appear to boost efficacy on bleachable stains. Additionally, Formulas 4-7 showed acceptable enzyme stability notwithstanding the absence of linear alcohol ethoxylate surfactant.

TABLE 2

Performance of Eco-Friendly Compositions Against Retail Products

| | Percent (%) of the Stain Remaining | | | | | |
|---|---|---|---|---|---|---|
| Standard Stain | Retail 1 | Retail 2 | Retail 3 | Formulation 1 | Formulation 7 | Formulation 8 |
| Animal Blood | 89.08 | 89.27 | 89.88 | 89.53 | 87.78 | 85.16 |
| Bacon Grease | 89.03 | 89.11 | 89.33 | 89.26 | 87.41 | 85.95 |
| Black todd clay | 89.01 | 88.86 | 89.84 | 89.77 | 86.97 | 84.94 |
| Canola Oil | 89.57 | 89.79 | 89.88 | 89.76 | 88.01 | 86.10 |
| Chocolate | 76.95 | 85.53 | 84.89 | 86.24 | 82.44 | 81.19 |
| Coffee Ice Cream | 83.71 | 84.79 | 85.82 | 85.98 | 83.25 | 81.29 |
| Grass | 87.09 | 87.44 | 89.54 | 88.73 | 87.58 | 85.39 |
| Ground in Dirt | 81.92 | 79.54 | 82.47 | 82.63 | 78.78 | 69.59 |
| Lipstick | 56.90 | 60.91 | 56.50 | 56.96 | 57.47 | 56.23 |
| Make-Up | 81.12 | 83.02 | 81.47 | 78.24 | 75.83 | 74.91 |
| Olive Oil | 89.58 | 89.65 | 89.85 | 89.81 | 87.90 | 85.95 |
| Tea | 79.68 | 83.42 | 83.75 | 83.62 | 83.06 | 82.11 |
| Tomato Sauce | 89.44 | 89.57 | 89.93 | 89.98 | 87.52 | 85.79 |
| Wine | 81.35 | 84.56 | 84.03 | 82.82 | 82.02 | 80.13 |
| Cocoa | 81.31 | 88.97 | 89.46 | 89.23 | 86.92 | 85.70 |
| Balsamic Vinaigrette | 88.51 | 88.45 | 89.20 | 88.92 | 86.46 | 85.08 |
| Spaghetti Sauce | 87.56 | 87.09 | 89.41 | 89.22 | 88.34 | 86.76 |
| Hamburger | 88.94 | 88.88 | 88.87 | 89.02 | 86.70 | 85.88 |
| Taco Grease | 86.95 | 86.20 | 86.66 | 87.01 | 86.06 | 84.83 |

We have thus described ecologically friendly laundry detergent compositions that show acceptable performance on both bleachable and non-bleachable stains. This new invention relies on the synergistic effect between surfactant-builder-enzyme combinations and natural essences to give unexpected performance from environmentally responsible compositions.

We claim:

1. A liquid laundry detergent composition comprising:

A. a surfactant mixture consisting of:

a. from about 1% to about 20% by weight of an alkyl ether sulfate of the general formula $R—(OCH_2CH_2)_x—O—SO_3M$, where R is a non-petroleum derived fatty alcohol with even number carbon chain lengths of from about $C_8$ to about $C_{20}$, and where x is from about 0.5 to about 8, and where M is an alkali metal or ammonium cation;

b. from about 1% to about 10% by weight of a fatty alcohol ethoxylate of general formula $R—(OCH_2CH_2)_x—OH$, where R is a non-petroleum derived fatty alcohol with even number carbon chain lengths of from about $C_{10}$ to about $C_{18}$, and where x is from about 0.5 to about 9; and c. optionally from about 1% to about 10% by weight of a fatty acid soap;

B. from about 0.1% to about 5% of a natural essence;

C. from about 0.1% to about 10% by weight of a builder; and

D. water.

2. The liquid laundry detergent composition of claim 1, wherein said builder is selected from the group consisting of hydroxides, carbonates, sesquicarbonates, bicarbonates, borates, citrates, and zeolites, and mixtures thereof.

3. The liquid laundry detergent composition of claim 1 further comprising a detersive enzyme selected from the group consisting of lipase, cellulase, protease and amylase, and mixtures thereof.

4. The liquid laundry detergent composition of claim 1 wherein said fatty acid soap is selected from the group consisting of sodium salts of saturated $C_{12}$-$C_{18}$ carboxylic acids, sodium salts of unsaturated $C_{12}$-$C_{18}$ carboxylic acids, potassium salts of saturated $C_{12}$-$C_{18}$ carboxylic acids, and potassium salts of unsaturated $C_{14}$-$C_{18}$ carboxylic acids, and mixtures thereof.

5. The liquid laundry detergent composition of claim 1 wherein said natural essence is a naturally occurring plant, tree, nut, seed, or fruit extract, or mixtures thereof.

6. The liquid laundry detergent composition of claim 1, wherein said natural essence is a synthetic mixture of organic materials.

7. The liquid laundry detergent composition of claim 1, further comprising a polymer selected from the group consisting of sodium polyacrylate having molecular weight from about 2,000 to about 10,000, and carboxy methyl cellulose, or mixtures thereof.

8. The liquid laundry detergent composition of claim 1, wherein said natural essence is selected from the group consisting of musk oil, civet oil, ambergris oil, castoreum oil, abies oil, ajowan oil, almond oil, ambrette seed absolute, angelic root oil, anise oil, basil oil, bay oil, benzoin resinoid, bergamot oil, birch oil, bois de rose oil, broom absolute, cajeput oil, cananga oil, capsicum oil, caraway oil, cardamon oil, carrot seed oil, cassia oil, cedar leaf oil, cedar wood oil, celery seed oil, cinnamon bark oil, citronella oil, clary sage oil, clove oil, cognac oil, coriander oil, cubeb oil, cumin oil, camphor oil, dill oil, elemi gum, estragon oil, eucalyptol nat., eucalyptus oil, fennel sweet oil, galbanum res., garlic oil, geranium oil, ginger oil, grapefruit oil, hop oil, hyacinth absolute, jasmine absolute, juniper berry oil, labdanum res., lavender oil, laurel leaf oil, lemon oil, lemongrass oil, lime oil, lovage oil, mace oil, mandarin oil, mimosa absolute, myrrh absolute, mustard oil, narcissus absolute, neroli bigarade oil, nutmeg oil, oakmoss absolute, olibanum res., onion oil, opoponax res., orange oil, orange flower oil, origanum, orris concrete, pepper oil, peppermint oil, peru balsam, petitgrain oil, pine needle oil, rose absolute, rose oil, rosemary oil, safe officinalis oil, sandalwood oil, sage oil, spearmint oil, styrax oil, thyme oil, tolu balsam, tonka beans absolute, tuberose absolute, turpentine oil, vanilla beans absolute, vetiver oil, violet leaf absolute, ylang ylang oil, α-pinene, β-pinene, d-limonene, 3,3,5-trimethylcyclohexanol, linalool, geraniol, nerol, citronellol, menthol, borneol, borneyl methoxy cyclohexanol, benzyl alcohol, anise alcohol, cinnamyl alcohol, β-phenyl ethyl alcohol, cis-3-hexenol, terpineol, anethole, musk xylol, isoeugenol, methyl eugenol, α-amylcinnamic aldehyde, anisaldehyde, n-butylaldehyde, cumin aldehyde, cyclamen aldehyde, decanal, isobutyl aldehyde, hexyl aldehyde, heptyl aldehyde, n-nonyl aldehyde, nonadienol, citral, citronellal, hydroxycitronellal, benzaldehyde, methyl nonyl acetaldehyde, cinnamic aldehyde, dodecanol, α-hydroxylcinnamic aldehyde, undecenal, heliotropin, vanillin, ethyl vanillin, methyl amyl ketone, methyl β-naphthyl ketone, methyl nonyl ketone, musk ketone, diacetyl, acetyl propionyl, acetyl butyryl, carvone, menthone, camphor, acetophenone, p-methyl acetophenone, ionone, methyl ionone, amyl butyrolactone, diphenyl oxide, methyl phenyl glycidate, γ-nonyl lactone, coumarin, cineole, ethyl methyl phenyl glicydate, methyl formate, isopropyl formate, linalyl formate, ethyl acetate, octyl acetate, methyl acetate, benzyl acetate, cinnamyl acetate, butyl propionate, isoamyl acetate, isopropyl isobutyrate, geranyl isovalerate, allyl capronate, butyl heptylate, octyl caprylate octyl, methyl heptynecarboxylate, methine octynecarboxylate, isoacyl caprylate, methyl laurate, ethyl myristate, methyl myristate, ethyl benzoate, benzyl benzoate, methylcarbinylphenyl acetate, isobutyl phenylacetate, methyl cinnamate, cinnamyl cinnamate, methyl salicylate, ethyl anisate, methyl anthranilate, ethyl pyruvate, ethyl α-butyl butylate, benzyl propionate, butyl acetate, butyl butyrate, p-tert-butylcyclohexyl acetate, cedryl acetate, citronellyl acetate, citronellyl formate, p-cresyl acetate, ethyl butyrate, ethyl caproate, ethyl cinnamate, ethyl phenylacetate, ethylene brassylate, geranyl acetate, geranyl formate, isoamyl salicylate, isoamyl isovalerate, isobornyl acetate, linalyl acetate, methyl anthranilate, methyl dihydrojasmonate, nopyl acetate, β-phenylethyl acetate, trichloromethylphenyl carbinyl acetate, terpinyl acetate, and vetiveryl acetate, and mixtures thereof.

* * * * *